United States Patent [19]

Steffen

[11] Patent Number: 4,800,653

[45] Date of Patent: Jan. 31, 1989

[54] METHOD AND APPARATUS FOR CONTROLLING THE DRYING AND COOLING OF FIELD-HARVESTED SEEDS IN STORAGE

[76] Inventor: Sylvester L. Steffen, 321 E. Hamilton, New Hampton, Iowa 50659

[21] Appl. No.: 67,347

[22] Filed: Aug. 17, 1979

Related U.S. Application Data

[63] Continuation of Ser. No. 811,700, Jun. 30, 1977, abandoned, which is a continuation of Ser. No. 422,760, Dec. 7, 1973, abandoned, which is a continuation of Ser. No. 179,889, Sep. 13, 1971, abandoned.

[51] Int. Cl.[4] ..... F26B 23/04

[52] U.S. Cl. ..... 34/30; 34/48; 34/230; 34/233; 98/55

[58] Field of Search ..... 34/26, 28, 30, 46, 48, 34/230, 233; 219/368; 21/92; 426/236, 465; 98/55

[56] References Cited

U.S. PATENT DOCUMENTS

| | | | |
|---|---|---|---|
| 2,938,101 | 5/1960 | Borzner | 219/368 |
| 3,217,424 | 11/1965 | Johnson et al. | 34/48 |
| 3,426,445 | 2/1969 | Steffen | 34/233 |

*Primary Examiner*—Henry A. Bennet
*Attorney, Agent, or Firm*—Herman H. Bains

[57] ABSTRACT

Method and apparatus for conditioning and preserving living seeds in a bin of the type having means for forcing air into a plenum chamber in the lower part of the bin, a floor pervious to gas flow forming the top of the chamber, and heating means. Electrical heating means such as heat lamps are utilized to introduce energy into the plenum air. A variation is disclosed wherein the heating means and plenum chamber are located in the upper part of the bin, and the air flow is from top to bottom.

The process involves measuring the temperature of drying air in the plenum chamber, measuring the temperature of exhaust air leaving the bin, and inactivating the heating means when the difference between the two temperatures exceeds a predetermined level. Energy is introduced into the plenum-air to supplement the air's natural capacity for holding moisture; a temperature sensing element in the exhaust-air activates or deactivates the energy sources according to a pre-selected (manual or automatic) allowable temperature depression that occurs from evaporative cooling. The differential setting is selectively controllable to accommodate the hygroscopic properties of differing seeds and variations of seasonal temperatures and humidities.

32 Claims, 3 Drawing Sheets

METHOD AND APPARATUS FOR CONTROLLING THE DRYING AND COOLING OF FIELD-HARVESTED SEEDS IN STORAGE

This application is a continuation of application Ser. No. 811,700 filed June 30, 1977, which was a continuation of application Ser. No. 422,760 filed Dec. 7, 1973, which was a continuation of application Ser. No. 179,889 filed Sept. 13, 1971, all previous applications now being abandoned.

BACKGROUND OF THE INVENTION

The technique of early harvesting including field shelling and subsequent conditioning of corn and other cereal grains in storage is becoming increasingly popular. The present methods of conditioning of drying these cereal grains range from simply storing the seeds and letting them dry in the atmosphere to placing them in drying bins and passing heated air through the grain seeds. In more recent years, complicated mechanical devices for agitating the stored grain or removing the bottom-most layer of stored grain have increased equipment and operational expenses and severely damaged both the physical and food properties of the grains and not infrequently the storage structure itself.

Grain exposed by storing in atmospheric air frequently is inadequately dried, and in most cases the drying process is so slow that problems of mold and biochemical changes result in serious losses to the stored grain. Also, drying of this type is interrupted by undesirable weather conditions, such as high humidity or prolonged wet and rainy periods, both of which result in accelerated degradation of the stored grain.

Wet grain that is artificially dried by flow of heated air in a drying bin is frequently damaged due to the fact that commercial drying techniques often use drying air temperatures of from 100° F. to 140° F., and sometimes even as high as 200° F., with resultant destruction of enzymes and amino acid proteins and other volatile ingredients.

The early harvesting techniques used in producing corn today frequently involve field shelling of the corn when it is at about 27% moisture. At this moisture level grain deteriorates rapidly and becomes mold infested. Corn approaches physiological maturity when its moisture content is approximately 20%. The maturing process involves not only the removal of moisture, but also chemical stabilization. Because mature corn is more stable it may be stored safely over long periods under proper conditions, while storing of corn with excessive moisture prevents the natural occurrence of biological maturity. Maturing involves the chemical stabilization of starch and protein which constitutes about 85% of the corn kernel. In the maturing process, sugar molecules bond together to form starch molecules which are more complex carbohydrates and are more stable chemically. Similar processes are involved with proteins and amino acids. In these processes water is eliminated, and thus drying or the elimination of water is an essential aspect of maturing of grain. Temperature and moisture are both factors in grain stabilization; however, above certain moisture levels, chilling of grain does not prevent deterioration of the seed.

GERMINATION LOSS IN STORED, REFRIGERATED CORN.

| | GERMINATION | | EMERGENCE* | |
|---|---|---|---|---|
| MOISTURE | AFTER 6 MOS. | AFTER 18 MOS. | AFTER 6 MOS. | AFTER 18 MOS. |
| Above 24% | 17% | 0% | 0% | 0% |
| 18–24% | 42% | 13% | 33% | 53% |
| 16–18% | 74% | 71% | 59% | 88% |
| 14–16% | 70% | 73% | 56% | 86% |
| 12–14% | 75% | 75% | 47% | 93% |
| 10–12% | 65% | 69% | 70% | 91% |
| Under 10% | 74% | 73% | 75% | 84% |
| AVERAGE | | | 56.5% | 82.5% |

Storage temperature approximately 35° F.
*Percentage Emergency within five days of planting.

A comprehensive discussion of synthesis and hydrolysis of starch and protein in grain may be found in U.S. Pat. No. 3,408,747, which also discloses a process of conditioning grain which relies on specific volumes of air flow through the grain to be dried.

SUMMARY OF THE INVENTION

This invention relates to a method and apparatus for conditioning grain that has a moisture content which is excessive for satisfactory long term storage of the grain, and more specifically to a method and apparatus for conditioning grain in a manner which more closely approximates natural drying of the grain. According to this invention, grain to be conditioned or dried is placed in a storage bin, generally of the type having a means for blowing drying air into a plenum chamber below the body of grain to be dried. The roof of the plenum chamber, which is also the floor of the storage bin, is pervious to gas flow and allows the drying air to percolate up through the body of grain to be dried. Bins of this type are quite common, and usually include a blower furnace as the means for supplying drying air to the bin.

In the present invention, the drying which is effected much more closely approximately what can be termed natural drying, and specifically it utilizes a flow of air and a heat source which is more controllable and less destructive to the grain than prior art techniques. Strictly natural air drying is not fully adequate to reduce grains to moisture levels safe for long-term storage, due to humidity and temperature conditions that exist in fall and early winter.

NATURAL AIR GRAIN DRYNESS* BY THE MONTH (IOWA)

| | AVG. CORN MOISTURE | WET-BULB** DEPRESSION | | AVG. CORN MOISTURE | WET-BULB** DEPRESSION |
|---|---|---|---|---|---|
| Jan. | 20% | 1°–2° | July | 11½% | 7°–10° |
| Feb. | 19% | 1°–3° | Aug. | 12% | 7°–9° |
| March | 17% | 2°–5° | Sept. | 13% | 6°–8° |
| April | 16% | 5°–7° | Oct. | 14% | 5°–7° |
| May | 13½% | 7°–8° | Nov. | 16% | 3°–5° |
| June | 13½% | 7°–8° | Dec. | 19% | 1°–3° |

*Varies With Different Grains; also with varietal and seasonal differences.
**Average Mean Wet-Bulb Depressions From U.S. Weather Bureau Data.

It is not uncommon for the drying air used in conventional processes to be at a temperature of 110° F. to 140° F., and occasionally even higher such as up to 200° F. It would seem that such temperatures would speed drying, but because of the sharp contrast with ambient temperatures as the air approaches the surface, resulting in moisture condensation and blockage to airflow, the drying process is slowed. When grain is stirred, condensation on binwalls is intensified because of contrasting temperatures resulting in rusted walls and rotted grain. Destruction of protein, loss of corn oils and other heat susceptible ingredients can result in as much as two pounds per bushel loss of weight when high heat drying is utilized.

Commonly, hydrocarbon fuels such as propane are used as a heat source. The combustion of these fuels is associated with the production of water. The BTU per hour output of heaters commonly employed range from 500,000 to 3,000,000 so that the per day production of water as a product of combustion can range from 75 to 500 gallons. This vapor is in the air that goes through the grain.

The seriousness of this problem is attested to by the fact that nearly every drying bin has crusted and sprouting surface grain, overdried bottom-grain, rusting of binwalls and rotting of grain.

Present principles and practices of drying stored grain are based on the assumption that obtaining saturated exhaust-air is desirable. In the prior art, specific zones in the grain bulk are referred to, i.e., the dry zone, the drying zone and the wet zone. The process of this invention departs fundamentally from this generally accepted assumption and employs a controlled balance of volume of air flow to grain volume and of air dryness to grain dryness while avoiding the clash of warm grain air temperatures with cool or cold ambient temperatures. The effect is to maintain a relative humidity in the exhaust air below saturation so that some drying can occur within the entire bulk of grain and thus eliminate the "wet zone" of high-moisture perishable grain exposed to saturated air; accelerated rates of respiration (in the grain itself and in molds and other micro-organisms exposed to warm, humid conditions) that intensify losses of weight and food value are prevented.

Weight losses of 1% of the dry matter have been found to correlate to a 20% loss of germination, and in todays economy, such deterioration can amount to as much as 20¢ per bushel loss in value. Since loss of germination means loss of value, it is desirable to maintain maximum germination. Therefore, maximum control provides maximum germination, and the induction of dormancy from the earliest time following the harvest of the grain by exposing the harvested grain to controlled air flow and moisture removal is desirable. Dormancy is a state of retarded respiration; accelerated respiration increases kernel food consumption and weight loss. Respiration is the conversion of oxygen to carbon dioxide and is exothermic, i.e, heat is generated. Thus, when high-moisture corn is exposed to warm saturated air, the rapid development of mold and heating of grain is intensified by the exothermic process of respiration as well as by the external addition of heat.

The process of this invention utilizes the fact that as water evaporates from a surface, the surface becomes cool. Therefore, as dry air is passed through the body of moist grain, evaporation takes place and cools the grain air a certain amount; the amount of cooling being dependent upon a number of factors such as the particular grain being dried, the temperature of the drying air, the moisture content of the grain, and the relative humidity of the drying air. The effect of evaporative cooling is to render the kernel and micro-organism dormant and thus stabilize the kernels and micro-organisms. It is a feature of this invention that the drying air is not heated to such an extent that the grain can be damaged thereby or overdried. It is desired to approximate as closely as practicable the conditions of natural air drying, and accordingly, the drying air is preferably conditioned only to control its dryness or relative humidity without greatly raising it above ambient temperatures.

The temperature of the plenum air is controlled, such as by a thermostat or other similar modulating or cycling device. According to one aspect of the invention, the temperature differential between plenum-air and exhaust air is monitored, and the heating means is inactivated when the differential exceeds a preselected value.

In the case of excessive differential, overdried grain will result, if saturated air is obtained deteriorative conditions are established; the process of this invention maximizes utilization of natural air, and maximizes preservation of seed quality and market weight and value.

Specifically, according to this invention, a controlled flow of ideal, natural "harvest air" is maintained within the stored grain with an apparatus for measuring and controlling natural air dryness or relative humidity so as to control grain dryness and dormancy. The addition of dry energy (heat) to the drying air is selectively controllable so as to determine the extent of drying that can occur within the grain. This is accomplished by obtaining a measure of the "dry-bulb" temperature and the "wet-bulb" temperature depression that occurs within the grain mass that is associated with the evaporation of water and with the addition of heat only when the wet-bulb depression is less than the pre-determined tolerance.

According to this invention, the conditions of natural drying are approximated as nearly as possible, consistent with minimum loss of seed germination quality and maximum use of air.

Since only a small rise in temperature of the drying air is required in this process, electrical heating means are ideally suited, and because of their extraordinary safety, convenience and serviceability, heat lamps are preferred as a means for heating the drying air. Heat lamps distributed about the plenum chamber uniformly warm the metal floor and floor supports, giving good distribution of the added heat. The exceptional economies of light energy as a heat source are well known.

Additionally, radiant heat energy from electrical sources is totally dry energy and does not aggravate problems of moisture condensation as does the combustion of hydrocarbon fuels.

In summary, this process teaches that because of the sensitive nature of seeds and other products with similar sensitivities, the application of heat as used in conventional drying of non-living products is excessive and intolerably damaging, and that preservation of weight and food value in grain is accomplished only in preserving the biological integrity of the seed.

Further, even when drying is accomplished with low levels of heat, these can be excessive because of the adverse environment created by the heat in increasing seed respiration and in causing stratification of moisture within the grain which allows for mold infestation.

Because of high costs of energy and limitations of energy resources, their wise management, especially in drying grains, is obviously urgent because of the vast expenditure of energy resulting from the growing practice of drying food grains.

More specifically, this invention includes a process wherein the biological integrity or living character of biological products, especially food grains, is preserved by drying, chilling and conditioning in a controlled storage environment; such control of storge environment is by ventilation, which maintains a balanced ratio of air-volume to grain-volume, and which prevents stagnation of and accumulating of moisture in the interstitial grain-air; and that throughout the conditioning process, the temperature of the product in storage remains colder than ambient temperatures and that when the product has achieved the desired equilibrium moisture it is at the same temperature as the ambient air.

Furthermore, monitoring means indicate the extent of heat expenditure or evaporative cooling during ventilation, i.e., the differential temperature observed from the time the air enters the grain to the time it exhausts, thereby, providing direct indication of equilibrium moisture being achieved within the grain at any given time; and, control means which automatically activate or deactivate heat sources in response to evaporative cooling and make possible the selective control of moisture content in the grain by selective control of differential temperatures.

Accordingly, it is an object of this invention to provide a method and apparatus for conditioning grain to controlled dormancy and moisture, and to maximize weight and market value for specific markets while maintaining optimum seed condition.

It is a further object to provide a method and apparatus for "cool-drying" grain by reference to the temperature differential between dry-air and wet-air in which the dry-air temperature is automatically regulated and the source of heating the drying air can be inactivated when the difference between the wet-air temperature (exhaust) and the dry-air temperature (plenum) is greater than the preset tolerance, allowing for fluctuations of the plenum-air temperature that occur seasonally.

DESCRIPTION OF THE PREFERRED EMBODIMENT

Figure 1:
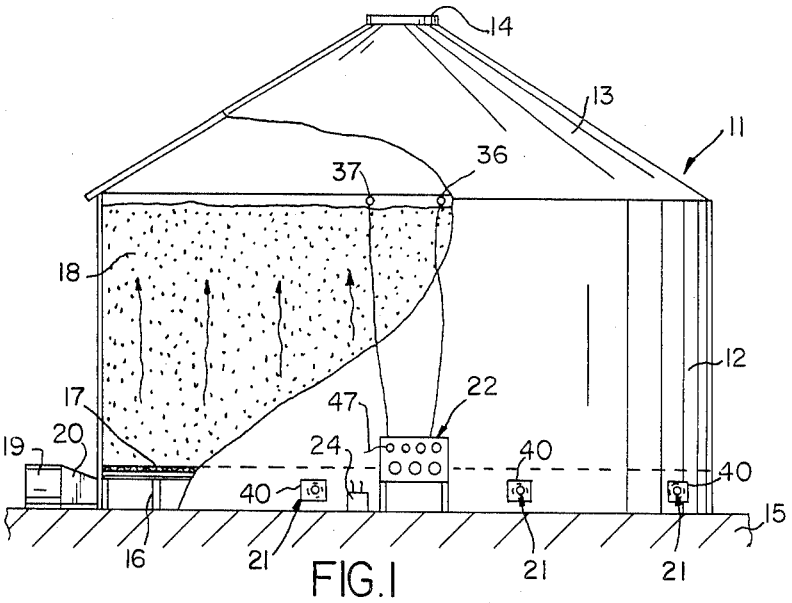
FIG. 1 is a side elevational view, partially cut away, showing a grain bin equipped according to this invention.

According to a preferred embodiment of this invention, a method and apparatus are provided which have the ability to produce grain having precisely controlled levels of moisture and also provides that these levels are obtained in a manner which results in minimum germination loss of the grain with resultant maximum quality for ultimate use. Some processing techniques require specific moisture levels, and the ability to supply grain with these specific levels will produce competitive advantages in certain cases.

A feature of this invention is that the ultimate grain moisture can be obtained by selected settings of the controls. These controls include a thermometer mounted so as to measure plenum-air temperature, and a temperature cycling control, such as a thermostat, that activates or deactivates heat sources in response to the plenum-air temperature. A second thermometer, sensing the temperature of the exhaust air, provides a differential reading of temperature from the plenum-air so as to provide an indication of grain moisture and extent of drying taking place. The differential reading, when greater than a preset level, causes the heat sources to be inactivated regardless of the thermostat setting.

TABLE I

GRAIN MOISTURE EQUILIBRIUM. CORN. ROUGH RICE. SOYBEANS.

| DRY, PLENIUM-AIR TEMPERATURE | WET, EXHAUST-AIR TEMPERATURE | | | | | | | | | | | | | | | |
|---|---|---|---|---|---|---|---|---|---|---|---|---|---|---|---|---|
| | 80° F. | 75° F. | 70° F. | 65° F. | 60° F. | 55° F. | 50° F. | 45° F. | 40° F. | 35° F. | 30° F. | 25° F. | 20° F. | 15° F. | 10° F. | 5° F. |
| 80° F. | 23.2 | 16.6 | 13.9 | 11.7 | 10.5 | Corn | | | | | | | | | | |
| | 22.4 | 15.8 | 13.1 | 10.9 | 9.7 | Rough Rice | | | | | | | | | | |
| | 20.7 | 14.1 | 11.4 | 9.2 | 8.0 | Soybeans | | | | | | | | | | |
| 75° F. | | 23.8 | 17.1 | 14.2 | 12.0 | 10.5 | Corn | | | | | | | | | |
| | | 23.0 | 16.3 | 13.4 | 11.2 | 10.0 | Rough Rice | | | | | | | | | |
| | | 21.3 | 14.6 | 11.7 | 9.5 | 8.3 | Soybeans | | | | | | | | | |
| 70° F. | | | 24.3 | 17.6 | 14.5 | 12.4 | 11.1 | Corn | | | | | | | | |
| | | | 23.5 | 16.8 | 13.7 | 11.9 | 10.3 | Rough Rice | | | | | | | | |
| | | | 21.8 | 15.1 | 12.0 | 9.9 | 8.6 | Soybeans | | | | | | | | |
| 65° F. | | | | 24.9 | 18.1 | 14.7 | 12.7 | 11.4 | Corn | | | | | | | |
| | | | | 24.1 | 17.3 | 13.9 | 11.9 | 10.6 | Rough Rice | | | | | | | |
| | | | | 22.4 | 15.6 | 12.2 | 10.2 | 8.9 | Soybeans | | | | | | | |
| 60° F. | | | | | 25.5 | 18.6 | 15.0 | 13.0 | 11.6 | Corn | | | | | | |
| | | | | | 24.7 | 17.8 | 14.2 | 12.2 | 10.8 | Rough Rice | | | | | | |
| | | | | | 23.0 | 16.1 | 12.5 | 10.5 | 9.1 | Soybeans | | | | | | |
| 55° F. | | | | | | 25.0 | 19.0 | 15.4 | 13.3 | 11.8 | Corn | | | | | |
| | | | | | | 24.2 | 18.2 | 14.6 | 12.5 | 11.0 | Rough Rice | | | | | |
| | | | | | | 22.5 | 16.5 | 12.9 | 10.8 | 9.3 | Soybeans | | | | | |
| 50° F. | | | | | | | 26.5 | 19.5 | 15.9 | 13.7 | 12.0 | Corn | | | | |
| | | | | | | | 25.7 | 18.7 | 15.1 | 12.9 | 11.2 | Rough Rice | | | | |
| | | | | | | | 24.0 | 17.0 | 13.4 | 11.2 | 9.5 | Soybeans | | | | |
| 45° F. | | | | | | | | 26.9 | 19.9 | 16.3 | 14.0 | 12.3 | Corn | | | |
| | | | | | | | | 26.1 | 19.1 | 15.5 | 13.2 | 11.5 | Rough Rice | | | |
| | | | | | | | | 24.4 | 17.4 | 13.8 | 11.5 | 9.8 | Soybeans | | | |
| 40° F. | 75% R.H. = 10° F. WET-BULB DEPRESSION* | | | | | | | | 27.4 | 20.4 | 16.6 | 14.4 | 12.5 | Corn | | |
| | 50% R.H. = 20° F. WET-BULB DEPRESSION* | | | | | | | | 26.6 | 19.6 | 15.8 | 13.6 | 11.7 | Rough Rice | | |
| | | | | | | | | | 24.9 | 17.9 | 14.1 | 11.9 | 10.0 | Soybeans | | |
| 35° F. | | | | | | | | | | 28.0 | 20.9 | 17.0 | 14.7 | 12.8 | Corn | |
| | | | | | | | | | | 27.2 | 20.1 | 16.2 | 13.9 | 12.0 | Rough Rice | |
| | | | | | | | | | | 25.5 | 18.4 | 14.5 | 12.2 | 10.3 | Soybeans | |
| 30° F. | | | | | | | | | Corn | | 28.5 | 21.3 | 17.4 | 15.0 | 13.1 | |
| | | | | | | | | | Rough Rice | | 27.7 | 20.5 | 16.6 | 14.2 | 12.3 | |
| | | | | | | | | | Soybeans | | 26.0 | 18.8 | 14.9 | 12.5 | 10.6 | |
| 25° F. | | | | | | | | | | Corn | | 29.0 | 21.7 | 17.7 | 15.3 | 13.5 |
| | | | | | | | | | | Rough Rice | | 28.2 | 20.9 | 16.9 | 14.5 | 12.7 |
| | | | | | | | | | | Soybeans | | 26.5 | 19.2 | 15.2 | 12.8 | 11.0 |

GRAIN MOISTURE EQUILIBRIUM
CORN. ROUGH RICE. SOYBEANS.

*Based on cooling that occurs with evaporation of water from a free surface.

Similar moisture equilibrium charts can be prepared for other grains.

Incorporated in this invention is electrical apparatus including heating means which provide indirect and direct conditioning of the air.

By means of electrically powered fans, a controlled volume of air is kept flowing through the grain according to grain moisture content as has been described in U.S. Pat. No. 3,408,747.

| REQUIRED C.F.M./BU. | |
|---|---|
| Percent moisture: | C.f.m./bu. |
| 30 | 9.0 |
| 28 | 7.0 |
| 25 | 5.0 |
| 22 | 3.5 |
| 20 | 2.5 |
| 18 | 1.5 |

Indirect electrial heating is obtained by fan blade friction and by the heat given off by electric motors powering the fans. Also, the pressure in the plenum would be above atmospheric, and the higher pressure gives greater drying capacity to the air as is well known. The combination of fan blade friction, electric motor heat and pressurized air may in some cases raise the temperature as much as from 2° to 5° F. This temperature increment together with ideal weather conditions can in some cases provide adequate capacity for accomplishing the desired degree of grain dryness. However, during most seasons the supplemental addition of some heat energy will be required. Electrical sources are ideally suited for this additional heat. Advantages obtained by electical heating include greater safety, in that the fire hazard is reduced compared to that when conventional blower furnaces are used or when propane burners are used. Service requirements are at a minimum and only require changing a light bulb or heat element in most cases. The present invention minimizes problems resulting from conventional high heat drying including uneven drying, overdrying, condensation of moisture within the grain causing accelerated biochemical activity, and moisture condensation on the bin walls. Conventional high-heat drying generally includes introducing the products of combustion into the drying bins, and as a result large amounts of water are introduced into the grain.

Referring now to FIG. 1 of the drawings, a grain storage bin 11 is shown having side walls 12, a conically shaped roof 13, and an opening 14 in the top of the roof. The bin has a foundation 15 and floor supports 16 supporting a floor 17 which is pervious to gas flow. A body of grain to be conditioned is indicated at 18, and a fan 19 and duct 20 leading from the fan for introducing air into the plenum chamber are shown. A group of heat lamps 21 mounted in frames 40 are located around the outer wall of the plenum chamber formed between the bin foundation and the bin floor, and control panel 22 is located on the sidewall 12 of the bin. According to the simplest aspect of this invention, the heat lamps 21 distributed about the lower part of the grain bin sidewalls 12 are simply turned on and left on during the eintre drying process, which may take several weeks. In some cases, the heat lamps 21 may be thermostatically controlled to maintain a desired temperature level in the plenum chamber.

According to a more complex aspect of the invention, a temperature sensing means 37 is shown in the top of the body of grain 18 and is located preferably near the center of the bin to minimize the effects of heat loss through the bin wall. Plenum air thermostat 33 (FIG. 3) with differential sensor 36 closes the circuit supplying power to cable 47 when the temperature of the plenum-air and exhaust air are within the range of present tolerances, i.e., if the exhaust-air drops below the present tolerance of cooling, the circuit is opened, or if the plenum-air temperature rises above the thermostat setting the circuit is broken.

As an alternative to the use of fan 19 and duct 20 as shown in FIG. 1, a plurality of small fans 24 could be spaced about the bin directly on the lower bin wall. These smaller fans would preferably be individually operable to guard against a surge of electrical load if all the fans were turned on together, and would include suitable closure means on each fan to prevent pressurized air from the plenum chamber from exiting through a fan that is not running.

Figure 3:
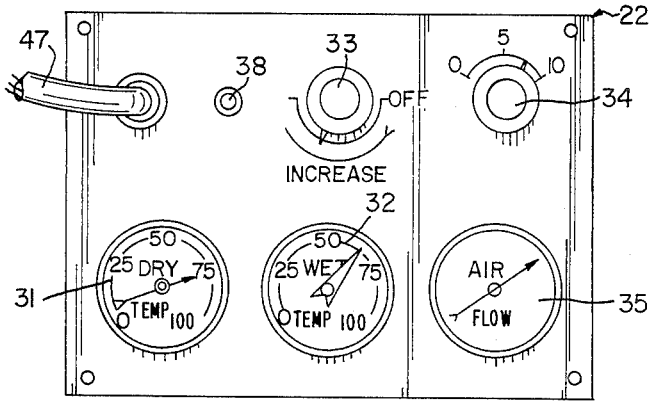
FIG. 3 is a front elevational view showing a control panel for use in accordance with this invention.

FIG. 3 shows a grain dryness control panel 22 suitable for mounting on the lower side wall of the bin below the floor 17.

The control panel includes: a thermometer 32 with a remote sensor 37 that measures the exhaust-air temperature; a thermometer 31 that measures the plenum-air temperature; a cycling (thermostat, humidistat) and/or modulating means 33 with remote sensor 36; and differential (humidity/temperature) selector 34; a light 38 indicating when the circuit is open or closed; a power cord 47 supplying power to the heat sources; and a manometer 35 that indicates airflow.

When corn moisture is above 26%, sufficient water is present so that evaporation and evaporative cooling approximates that of water from a free surface; therefore, the temperature depression measured in the exhaust-air when compared with that of the plenumair provides a relative wet-bulb depression reading. This being so, the previously cited moisture equilibrium chart (TABLE I) provides a meaningful guide (based on psychometric wet-bulb depressions) as to how dry the grain is becoming.

To obtain 13% moisture corn the optimum wet-bulb depression to be maintained should range from 7°-12° F. approximately.

As the grain dries, its hygroscopic property increasingly resists evaporation, and as evaporation decreases evaporative cooling also decreases. When grain moisture reaches equilibrium with air moisture, the plenum-air and exhaust-air temperatures will be the same and no drying will take place.

Therefore the comparison of these two temperatures provides positive indication as to when drying does or does not take place and as to how dry the grain is becoming; heretofore, the farmer could only guess about these situations.

The ultimate dryness of the grain is determined by the ultimate dryness of the air. It can be observed from a psychometric chart that a 10° F. wet-bulb depression represents approximately 75% relative humidity regardless of temperature, while a 20° F. wet-bulb depression represents approximately 50% relative humidity; average corn moisture obtained with a 75% relative humidity will be approximately 15%; while with 50% relative humidity, 11.6% moisture corn will be obtained. The actual wet-bulb depression observed in the surface grain will in fact be less than what the real wet-bulb depression is, and increasingly so according to a calculable amount as the grain dries, so that the observed reading to obtain the desired moisture level in the grain should be less than suggested by a psychrometric chart based on evaporative cooling from a free water surface. The corn moisture equilibrium chart comtained in U.S. Pat. No. 3,408,747 shows corn moisture levels below those cited on the chart contained in this invention and represents an accommodation to hygroscopic characteristics of grain as it dries.

The measure of wet-bulb depression is a measure of relative humidity; it is obvious therefore that controlling wet-bulb depression controls relative humidity.

When the setting on thermostat 33 is below the temperature observed on thermometer 31, the contacts of the thermostat are open and light 38 will be on.

When drying begins, thermostat 33 is set as desired (e.g. 6° F. above ambient) by turning the knob of 33 in the direction of "increase" indicated by the arrow.

When the thermostat setting is above the plenum temperature, the contacts close to activate the heat source and light 38 goes out.

When temperature of plenum is same as thermostat setting, the heat sources are deactivated. It can happen that because of low relative humidities in the natural air, overdrying can occur even though temperature of the plenum-air would never reach the thermostat setting. Undesirable overdrying would result if the heat source were not deactivated. Such conditions are indicated if the exhaust air temperature drops excessively below the plenum temperature, e.g. 10° F. An adjustable temperature differential control means 34 is provided in conjunction with the thermostat 33. Differential control means 34 is adapted to determine the differential between plenum air and exhaust air, and to automatically open the thermostat circuit, thereby deactivating the heat source, when the differential exceeds the value preset on control means 34.

The manometer 35 measures static pressure (inches water) and indicates the volume of air being delivered by the fan(s).

The required ratio of air-volume to grain-volume varies with the grain moisture; by knowing the acutal and the required ratios, the operator knows how fast the bin can safely be filled. The required ratios (cfm/Bu.) for heated air drying are defined in U.S. Pat. No. 3,408,747. Filling of the bin can continue as long as ratios are maintained.

By fixing the depth of grain (12–14') a prescribed horsepower requirement can be defined to maintain a certain level of air.

By maintaining a horsepower application of 1.5–2 h.p. per 1000 bushels of corn an air-to-grain ratio of 3 cfm/Bu. can be maintained and complete filling of the structure allowed. For example, 15 H.P. is recommended for 10,000 bushels of corn; a 33' diameter bin is required to obtain 10,000 bushels in a 12–14' depth. As grain depth increases, pressure increases and airflow decreases, thus decreasing the safe fill rate. Air volume has to be maintained according to grain moisture content as previously cited and is basically applicable to all cereal grains.

Heretofore it has been customary to use single fans. The application of multiple fans offers distinct advantages: lower electrical requirements; increased air flow; more uniform airflow, more easily serviced; more direct attachment to the bin by sizing fan housing to plenum depth and a more flexible application of horsepower to fit a wide variation of systems.

The fans 19 have flap closures 54 around the plenum chamber which allow the respective fan to introduce air into the plenum chamber, but which substantially prevent air from leaving the plenum chamber when that same respective fan is not operating.

Further it becomes practicable to prefabricate an electrical harness that attaches in series to the previous fan providing a simple "add on" approach to increase fan numbers in a given system.

It is a feature of this invention that grain can be dried in a manner more closely approximating natural drying, and overheating and overdrying of the grain can be avoided; specifically, satisfactory drying rates may be obtained without using supplemental heat sources such as the heat lamps 21 so long as the dryness of the air is consistent with the desired equilibrium dryness that will be obtained in the grain. When the outside air temperature is below about 50° F., or when it has a high humidity, the supplemental heat source can then be activated to provide the necessary heat to obtain proper drying rates.

The differential setting for the operation will vary with the particular grain being dried and the ultimate moisture content desired; a setting of 8°–10° F. is generally best for corn, while at 6°–9° F. differential is considered best for rough rice and a 4°–7° F. differential for soybeans.

It must be emphasized that adequate air flow must be provided in any drying operation of this type. As has been said, a thorough discussion of the importance of air volume to the drying operation appears in U.S. Pat. No. 3,408,747.

Dryness of the air determines dryness of the grain, while the volume of air employed determines how long it will take to complete drying.

Calculated averages for dryness, for time required, as well as probability of weight and germination losses (as described in U.S. Pat. No. 3,408,747) can be determined according to differing conditions of airflows.

For example, 26% moisture corn harvested on November 1, using 1½ cfm/Bu. and a temperature rise of 5° F. requires 44 days to dry to 13½% moisture with a 64% probability of losing 0.05% of dry matter (approximately 10% germination): doubling the air volume (3 cfm/Bu.) reduces the probability of weight loss to zero and reduces drying time to 22 days.

The application of this gradual process of moisture removal does not limit harvest capacities since under certain moisture levels (27%) instant and total filling of the bin is possible. Even now, structures up to 48' diameter are available with capacities in excess of 20,000 bushels.

Figure 2:
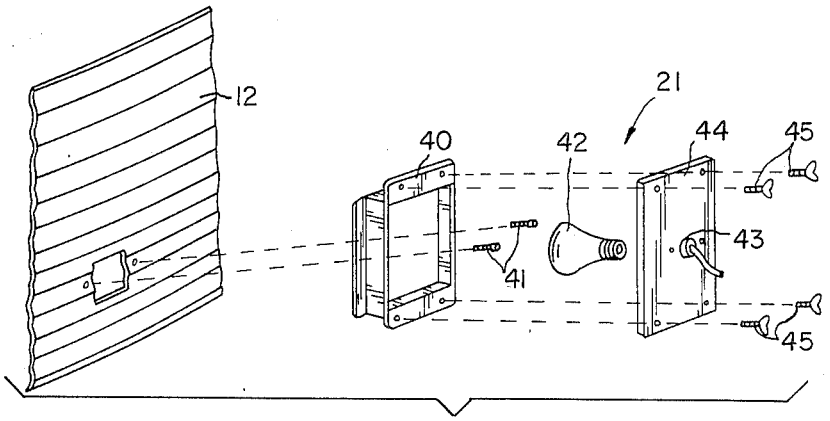
FIG. 2 is an exploded view showing the details of heat lamp mountings according to one aspect of the invention.

A preferred embodiment of the heating means to be utilized in this invention is illustrated in FIG. 2. As shown therein, a window frame 40 which may be round, square, or rectangular, attaches to the bin wall 12 by means of bolts 41 or other suitable means through holes in bin wall 12. Heat lamp 42 is carried by receptacle 43 carried on transparent window 44. Window 44 can be removed for changing a burned out lamp or for providing access to the plenum chamber for cleaning or inspection simply by removing bolts 45. Some of the adantages provided by this embodiment include ease of maintenance, access to plenum for inspection for cleaning, illumination of both plenum and grounds outside the bin, and prevention of mildew. This embodiment also reduces fire hazards which are present when flame heaters are used, and eliminates the pollution resulting from flame heaters or glowing resistance elements.

The operation of a preferred embodiment of the invention will be illustrated by reference to FIGS. 1 and 3 of the drawings. A grain bin 11 is filled with grain to be conditioned, such as by filling through the opening 14 in the roof 13 of the bin. After the grain 18 is in the bin and has been leveled, temperature sensor 37 and sensor 36 for the differential temperature control are placed in the bed of grain near the surface thereof. Depending upon the ambient temperature and humidity conditions, a desired drying temperature is set on the thermostat 33 and a selected setting for maximum tolerable differential. During fan 19 operation air is forced into the plenum chamber and up through the floor 17 into the body of grain 18 and eventually out the opening 14. As the drying air passes through the body of grain, moisture will tend to be removed from the grain into the air, and the resultant evaporation will cause a lowering of the temperature of the air. The extent of the temperature lowering will be indicative of the rate of removal of the water from the grain, and can be observed by the operator by reference to the thermometers 31 and 32. If the temperature differential indicated by thermometers 31 amd 32 exceeds the differential setting of control 34, this indicates that overdrying would occur, and the differential control 34 will function to inactivate the supplemental heating means. Drying will then continue utilizing air which has not had supplemental heat added thereto, other than the small amount resulting from the operation of the fan and motor. The differential temperature then will tend to work back toward the range set on the differential control 34, and if the differential temperature becomes less than the amount set on control 34, the thermostat may again cause the heat lamps 21 to become activated, adding heat to the drying air.

Figure 4:
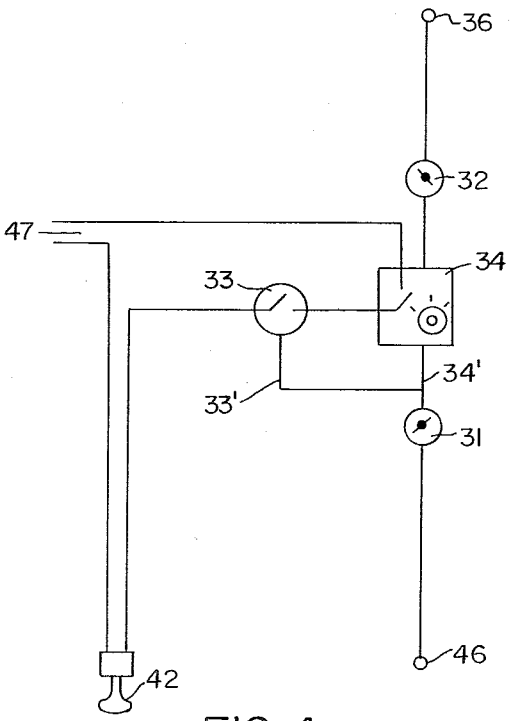
FIG. 4 shows a schematic operational circuit diagram of one embodiment of the invention.
Figure 6:
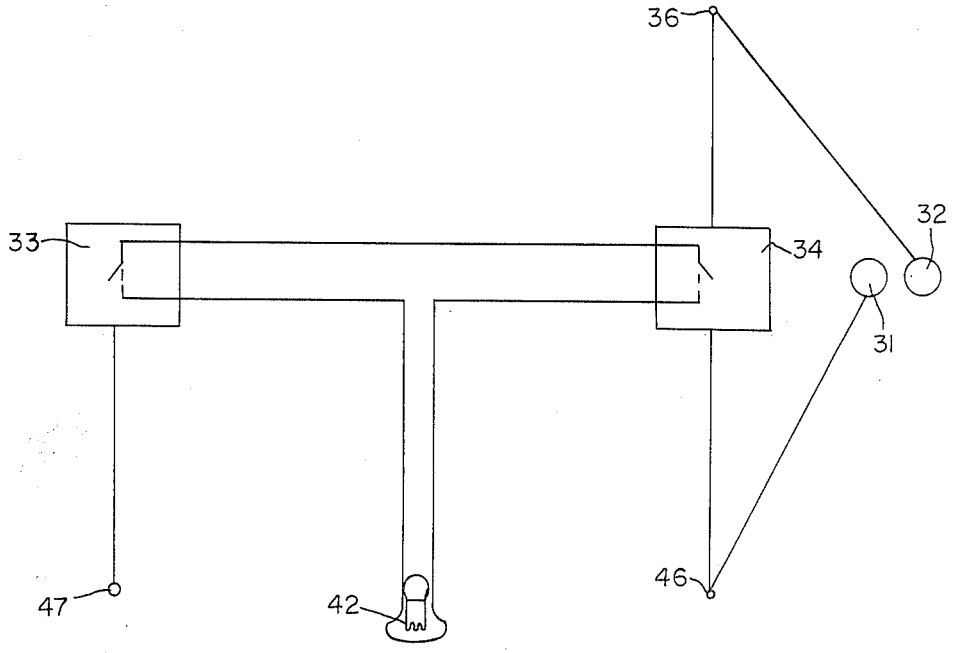
FIG. 6 is a partial perspective view of the multiple fan arrangement of the present invention.

In FIG. 4 the power cord 47 is connected to a power source (not shown) and forms a circuit having a heat lamp 42, a thermostat 33, and a differential temperature control 34 all connected in series. The thermostat 33 responds to warming through sensor 46. Thermometer 31 indicates the temperature in the plenum at sensor 45, and this temperature reading is also carried to thermostat 33 and differential controller 34 by lines 33' and 34' respectively. The temperature of the exhaust chamber of the grain bin is measured by sensor 35, which temperature reading is indicated on thermometer 32 and is also input into differential controller 34.

In operation, the FIG. 4 embodiment will operate the heat lamp 42 only when the contacts of both the thermostat 33 and the differential controller 34 are closed. Consequently, in order for the heat lamp to operate, the temperature sensed in the plenum by sensor 46 must be below the preset temperature of thermostat 33 in order to have the contact in thermostat 33 closed, and the differential temperature between sensors 36 and 46 (in the exhaust and plenum chambers respectively) must be less than the differential setting on differential controller 34. It will be understood that thermostat 33 and differential controller 34 respond to automatically close the contacts as well as open them to provide a fully automated control.

Figure 5:
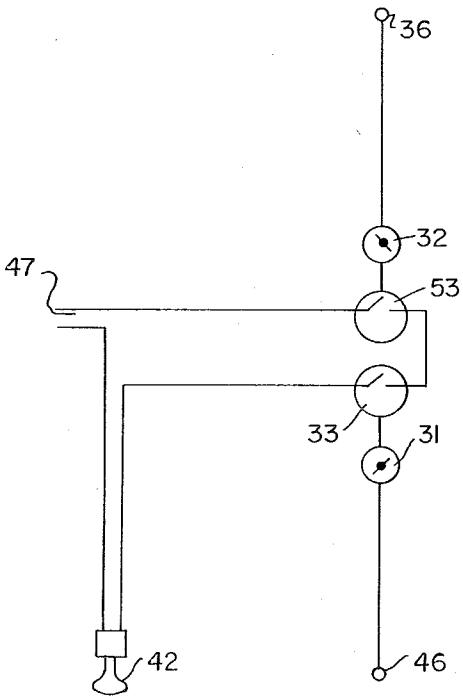
FIG. 5 shows a schematic operational circuit diagram of another embodiment of the invention.

In FIG. 5 the power cord is likewise connected to a power source (not shown) and has connected, in series therewith, a thermostat 33, a thermostat 53, and a heat lamp 42. Thermostat 33 operates exactly as described in the FIG. 4 embodiment, i.e. it responds to warming. Thermostat 33 closes the contact when the temperature at sensor 46 is below the setting thereon, and the contact is opened when the temperature at sensor 46 rises to the temperature set on the setting, or above the setting. Thermostat 53 works in a opposite fashion in that it responds to chilling, i.e. when the temperature sensed by sensor 36 is lower than the setting thereon, the thermostat 53 contact is open and when the temperature sensed by sensor 36 is at the setting or above, the circuit is closed. It will be understood that the heat lamp 42 operates only when the contacts of both thermostats 33 and 43 are closed. This arrangement, like that of the embodiment of FIG. 4, is fully automatic.

Since it is necessary to maintain proper volume of air to volume of grain, varying according to grain moisture, the importance of an airflow indicator is realized. A properly placed manometer, as is well known in the art, may be used to measure air flow.

Numerous modifications and variations could be made without departing from the scope of this invention. For example, it might be desireable to place the heat lamps 21 in the upper portion of the bin and reverse the air flow from the conventional to a top-to-bottom direction. This arrangement would take advantage of the fact that considerable solar heat is present in the upper part of a bin in certain conditions. Also, this arrangement would asssure that the driest air contacts the most recently added grain in the bin.

Additional variations will be readily apparent, and the invention is not to be limited to the specific preferred embodiments shown, but is to be defined by the appended claims.

I claim:

1. The process of drying and preserving seeds in a bin having heating means and means for forcing air into a plenum chamber in the lower part of the bin, said heating means being disposed in said plenum chamber, the chamber being covered by a floor pervious to gas flow, the process comprising the steps of:

introducing atmospheric air into the plenum chamber;

determining the temperature within the plenum chamber;

determining the temperature of exhaust air leaving the bin;

inactivating the heating means when the temperature of the air in the plenum chamber minus the temperature of the exhaust air is greater than a preselected amount; and controlling the amount of heat from said heating means to always maintain the exhaust air temperature cooler than the inlet air temperature while the grain is curing.

2. A grain drying bin as defined in claim 1 including:

means for determining the temperature of air in the plenum chamber;

means for determining the temperature of air as it exhausts the bin;

thermostat means responsive to the temperature of the air in the plenum chamber for controlling the operation of the heating means; and means adapted to override the thermostat controlling the heating means and inactivate the heating means when the temperature difference between the drying air in the plenum chamber and the air exiting the bin is greater than a predetermined amount.

3. A grain drying bin as defined in claim 2 including:

a plurality of heat lamps spaced about the bin wall adjacent the plenum chamber and having a total output of 10 to 40 watts per one hundred bushels of bin capacity.

4. A grain drying bin as defined in claim 3 including:

a plurality of fans distributed about the wall of the plenum chamber;

each fan being individually controlled and including closure means to prevent air from exiting the plenum chamber when the fan is inactivated.

5. A grain drying bin as defined in claim 4 including transparent heat lamp mounting plates detachably secured to the bin wall.

6. A grain drying bin as defined in claim 2 including means for indicating the amount of air being introduced into the plenum chamber.

7. A grain drying bin of the type having a plenum chamber formed in the lower part thereof and a gas-pervious floor forming the top of the plenum chamber including:

means for introducing atmospheric air into the plenum chamber;

heating means for adding heat energy to the air in the plenum chamber;

means for sensing the temperature of air in the plenum chamber;

means for sensing the temperature of air as it exhausts the bin;

thermostat means for controlling the operation of the heating means; and differential temperature control means adapted to override the thermostat means controlling the heating means and thereby inactivate the heating means when the temperature difference between the drying air in the plenum chamber and the air exiting the bin is greater than a predetermined amount.

8. A grain drying bin as defined in claim 7 including means for indicating the temperature of the air in the plenum chamber and means for indicating the temperature of the air exiting the bin.

9. A grain drying bin as defined in claim 7 wherein the means for introducing atmospheric air operates at approximately 1.5 to 9.0 cubic feet per minute per bushel of grain at moistures between 18 and 30 grain percent moisture.

10. A grain drying bin as defined in claim 7 including:

a control panel;

means mounted on the control panel for continuously indicating the temperature of the air in the plenum chamber;

means mounted on the control panel for continuously indicating the temperature of the air exiting the bin;

adjustable means mounted on the control panel for controlling the thermostat means; and adjustable means mounted on the control panel for controlling the temperature control means.

11. In a grain drying bin of the type having a first chamber formed in the lower part thereof, a gas-pervious floor forming the top of said first chamber, and a second chamber formed between the grain and the top of the grain bin, one of said chambers being an exhaust chamber, the improvement comprising:

means for introducing atmospheric air into the plenum chamber;

heating means for adding heat energy to the air in the plenum chamber;

means for sensing the temperature of air in the plenum chamber;

means for sensing the temperature of air in the exhaust chamber;

thermostat means operating in response to the temperature of air in the plenum chamber for controlling the operation of the heating means by activating the heating means when the temperature of the air in the plenum chamber is below a predetermined temperature and inactivating the heating means when the temperature of the air in the plenum chamber is above said predetermined temperature;

differential temperature control means operating in response to the difference in temperature between the air in the plenum chamber and the air in the exhaust chamber for overriding the activation of the heating means by the thermostat means when said difference in temperature exceeds a predetermined temperature amount to thereby inactivate the heating means only while the difference in temperature exceeds said predetermined temperature, said differential control temperature means having no overriding effect on the thermostat means when said difference in temperature does not exceed said predetermined temperature.

12. A grain drying bin as defined in claim 11 including means for indicating the temperature of the air in the plenum chamber and means for indicating the temperature of the air in the exhaust chamber.

13. In a grain drying bin of the type having a first chamber formed in the lower part thereof, a gas-pervious floor forming the top of said first chamber, and a second chamber formed between the grain and the top of the grain bin, one of said chambers being a plenum chamber and the other of said chambers being an exhaust chamber, the improvement comprising:

means for introducing atmospheric air into the plenum chamber;

heating means for adding heat energy to the air in the plenum chamber;

electric circuit means for controlling the heating means;

means for sensing the temperature of air in the plenum chamber;

thermostat means for opening or closing the circuit means in response to the temperature of air in the plenum chamber to thereby activate the heating means as long as the air in the plenun chamber is below a predetermined temperature; and differential temperature control means set at a predetermined temperature differential between the plenum air and the exhaust air for automatically opening the circuit means of the heating means when the predetermined temperature differential is exceeded and closing the circuit means when the differential temperature is less than the predetermined temperature differential setting.

14. A grain drying bin as defined in claim 13 including means for indicating the temperature of the air in the plenum chamber and means for indicating the temperature of the air in the exhaust chamber.

15. In a grain drying bin of the type having a first chamber formed in the lower part thereof, a gas-pervious floor forming the top of said first chamber, and a second chamber formed between the grain and the top of the grain bin, one of said chambers being a plenum chamber and the other of said chambers being an exhaust chamber, the improvement comprising:

means for introducing atmospheric air into the plenum chamber;

heating means for adding heat energy to the air in the plenum chamber;

means for sensing the temperature of air in the plenum chamber;

means for sensing the temperature of air in the exhaust chamber;

first thermostat means operating in response to the temperature of air in the plenum chamber for activating the heating means so long as the air in the plenum chamber is below a predetermined temperature; and second thermostat means operating in response to the temperature of air in the exhaust chamber for further controlling the heating means by automatically overriding the first thermostat means by preventing the operation of the heating means when the temperature of the air in the exhaust chamber is below a predetermined temperature, said predetermined temperature of said first thermostat means being higher than said predetermined temperature of said second thermostat means.

16. A grain drying apparatus as defined in claim 15 wherein said heating means is an electrical heating means.

17. A grain drying apparatus as defined in claim 16 wherein said electrical heating means has a total wattage of 10 to 40 watts per one hundred bushels of grain capacity.

18. A grain drying apparatus as defined in claim 16 wherein said electrical heating means comprises at least one heat lamp.

19. A grain drying apparatus as defined in claim 16 wherein said electrical heating means comprises a plurality of heat lamps.

20. A grain drying apparatus as defined in claim 19 wherein said means for introducing atmospheric air into the plenum chamber comprises a plurality of fans spaced about the plenum chamber.

21. A process for curing seeds comprising:

placing uncured seeds in a closed environment;

adding atmospheric air to one point of the closed environment, and allowing air to exit at another point in the closed environment;

maintaining the addition of atmospheric air within specified quantities;

measuring the temperature of the air at the point of entry of the atmospheric air and at the point of exhaust from the closed environment;

adding heat to the entering atmospheric air only when the temperature difference between the entering air minus the exiting air is less than a predetermined amount;

controlling the amount of such heat being added to thereby always maintain the temperature of the exiting air cooler than the temperature of the entering atmospheric air; and continuing the addition of atmospheric air and controlling the addition of heat to the atmospheric air until a desired equilibrium moisture has been achieved in the stored seeds.

22. A process as defined in claim 21 wherein the desired equilibrium moisture is at 18 percent and the temperature of the seeds are at 40° F.

23. A process of drying uncured seeds comprising the steps of:

placing uncured seeds in a closed environment;

adding atmospheric air to one point of the closed environment, and allowing air to exit at another point in the closed environment;

determining the temperature of the air at the point of entry into the seeds;

determining the temperature of the air at the point of exhaust from the seeds;

adding heat to the entering atmospheric air only when the difference between the temperatures of the entering air minus the exiting air is less than a predetermined amount required to achieve a desired equilibrium moisture in the stored seeds; and controlling the amount of such heat being added to thereby always maintain the temperature of the exiting air cooler than the temperature of the entering atmospheric air.

24. In a grain drying bin of the type having a first chamber formed in the lower part thereof, a gas-pervious floor forming the top of said first chamber, and a second chamber formed in the top of the grain bin, one of said chambers being a plenum chamber and the other of said chambers being an exhaust chamber, the improvement comprising:

means for introducing atmospheric air into the plenum chamber;

heating means for adding heat energy to the air in the plenum chamber;

means or sensing the temperature of the air in the plenum chamber;

means for sensing the temperature of the air in the exhaust chamber; and differential temperature control means operating in response to the difference in temperature between the air in the plenum chanber and the air in the exhaust chamber for activating the heating means when the result of the temperature in the plenum chamber minus the temperature in the exhaust chamber is a predetermined amount or less, and deactivating the heating means when the result of the temperature in the plenum chamber minus the temperature in the exhaust chamber is greater than said predetermined amount.

25. A grain drying bin as defined in claim 7 wherein said temperature differential is determined by subtracting the temperature of the exiting air in the exhaust chamber from the higher temperature of the inlet air in the plenum chamber.

26. A grain drying bin as defined in claim 11 whereby said temperature differential is determined by subtracting the temperature of the exiting air in the exhaust chamber from the higher temperature of the inlet air in the plenum chamber.

27. A grain drying bin as defined in claim 13 whereby said temperature differential is determined by subtracting the temperature of the exiting air in the exhaust chamber from the temperature of the inlet air in the plenum chamber.

28. In a grain bin of the type having a first plenum chamber formed in the lower part thereof, a gas-pervious floor forming the top of said first chamber, and a second exhaust chamber formed in the top of the grain bin, the improvement comprising:

means for bringing atmospheric air from the outside of said bin into said plenum chamber and causing said air to move successively from the outside of the bin, through the plenum chamber, through the floor, through the grain, through the exhaust chamber and out of the exhaust chamber to atmosphere;

heating means for adding heat energy to the air in said plenum chamber;

means for sensing the temperature of air at a first point prior to the entry of such air into the grain;

means for sensing the temperature of the air at a second point after it has passed through the grain in said exhaust chamber; and differential temperature control means operating in response to the difference in temperature between the air at the first point and the air at the second point for activating said heating means when the result of the temperature at the first point minus the temperature at the second point is a predetermined amount or less, and for deactivating said heating means when the result of the temperature at the first point minus the temperature at the second point is greater than said predetermined amount.

29. A process of drying and preserving seeds, said seeds being in a bin having heating means and means for forcing air from outside of the bin into a plenum chamber in the lower part of the bin, said heating means being disposed in said plenum chamber, said plenum chamber being covered by a floor pervious to gas flow, said process comprising the steps of:

introducing atmospheric air into said plenum chamber;

determining the temperature of the incoming air at a first point prior to its entry into the grain;

determining the temperature at a second point of exhaust air leaving the grain;

inactivating said heating means when the temperature of the air at the first point minus the temperature at the second point of the exhaust air is greater than a pre-selected amount; and controlling the amount of heat from said heating means always to maintain the exhaust air temperature at the second point cooler than the inlet air temperature at the first point while the grain is curing.

30. A process of drying uncured seeds comprising the steps of:

placing uncured seeds in a closed environment;

adding atmospheric air to one point of the closed environment, and allowing air to exit at another point in the closed environment;

determining the temperature of the entering air prior to the entry of such air into the seeds;

determining the temperature of the air exiting from the seeds;

adding heat to the entering atmospheric air only when the difference between the temperatures of the entering air minus the exiting air is less than a predetermined amount required to achieve a desired equilibrium moisture in the stored seeds; and controlling the amount of such heat being added whereby the temperature of the exiting air is cooler than the temperature of the entering atmospheric air.

31. A method of curing and drying food-seeds as defined in claim 21 wherein: said step of continuing the addition of atmospheric air for bringing the foodseeds into an equilibrium moisture with atmospheric air, results in the moisture content of the seeds not being reduced to levels below that which is seasonally normal from exposure to atmospheric air, and whereby the temperature of the seeds is not raised to levels above the seasonal normal of atmospheric temperatures.

32. A method of curing and drying food-seeds in a storage bin of a type having a first plenum for introducing atmospheric air into a mass of stored grain and a second plenum for receiving the exiting air, fan ventilation means, temperature sensing means in the first plenum and temperature sensing means of the grain/air at the exiting surface of the food-seeds, said method comprising:

activation of said fan ventilation means for bringing the food-seeds into an equilibrium of temperature and moisture with atmospheric air, whereby the moisture content of the seeds is not reduced to levels below that which is seasonally normal from exposure to atmospheric air, and whereby the temperature of the seeds is not raised to levels above the seasonal normal of atmospheric temperatures, the progress of curing and drying being monitored by means of sensing atmospheric wet-bulb-depressions which indicate the equilibrium moisture being obtained in the seeds and which control a heating means to prevent wet-bulb depressions from occurring in the stored seeds which are greater than seasonal normals of atmospheric air.

* * * * *